US005806756A

United States Patent [19]

Jenkins

[11] Patent Number: 5,806,756

[45] Date of Patent: Sep. 15, 1998

[54] CARTON CLOSURES HAVING ADHESIVE PATTERNS THEREON, AND A METHOD OF ASSEMBLING THE SAME

[75] Inventor: Paul M. Jenkins, Hendersonville, Tenn.

[73] Assignee: Illinois Tool Works Inc., Glenview, Ill.

[21] Appl. No.: 590,076

[22] Filed: Jan. 17, 1996

[51] Int. Cl.[6] ..... B65D 5/42

[52] U.S. Cl. ..... 229/136; 229/132; 229/134; 493/128; 493/183

[58] Field of Search ..... 229/132, 134, 229/136; 493/128–132, 183, 453

[56] References Cited

U.S. PATENT DOCUMENTS

| | | | |
|---|---|---|---|
| 2,351,166 | 6/1944 | Vergobbi | 229/132 |
| 2,521,208 | 9/1950 | Eaton | 229/134 |
| 2,670,128 | 2/1954 | Stowitts | 229/132 |
| 2,996,235 | 8/1961 | Turpin . | |
| 3,040,958 | 6/1962 | Hagen . | |
| 3,140,215 | 7/1964 | Russell . | |
| 3,194,473 | 7/1965 | Rumberger . | |
| 3,286,906 | 11/1966 | Rumberger . | |
| 3,934,791 | 1/1976 | Dick et al. . | |
| 4,083,486 | 4/1978 | Bergstein | 229/134 |
| 4,088,263 | 5/1978 | Michetti . | |
| 4,159,076 | 6/1979 | Engdahl, Jr. | 229/132 |
| 4,250,994 | 2/1981 | Focke | 229/134 |
| 4,501,388 | 2/1985 | Cassidy . | |
| 4,530,461 | 7/1985 | Adamek . | |
| 4,989,780 | 2/1991 | Foote et al. . | |
| 5,016,812 | 5/1991 | Pedigrew | 229/132 |
| 5,418,009 | 5/1995 | Raterman et al. . | |
| 5,520,602 | 5/1996 | Jenkins | 493/183 |

FOREIGN PATENT DOCUMENTS

| | | | |
|---|---|---|---|
| 1405596 | 9/1975 | United Kingdom | 229/132 |
| 2264286 | 8/1993 | United Kingdom | 229/132 |

*Primary Examiner*—Gary E. Elkins
*Attorney, Agent, or Firm*—Schwartz & Weinrieb

[57] ABSTRACT

A carton, and a method of assembling the same, is disclosed wherein the carton closures or flaps have adhesive applied to or deposited upon particular regions thereof such that the adhesive does not interfere with or foul conveyor or support mechanisms use in connection with the carton assembling or erection equipment carton is erected or assembled in accordance with reverse-fold techniques wherein each end of the carton to be sealed has a first inside major flap folded inwardly, a pair of oppositely disposed minor end flaps are then folded inwardly so as to be disposed atop opposite end portions of the first inside major flap, and a second outside major flap is then folded inwardly so as to be disposed upon the minor end flaps as well as covering that portion of the first inside major flap remaining uncovered by the folded minor end flaps. Longitudinally offset adhesive blocks or patches are provided upon the inside surface of the second outside major flap so as to seal the second outside major flap to the minor end flaps and the inside major flap along the joint or junction lines defined between the pair of minor flaps and the inside major flap. Additional adhesive caulking lines, and embossed or debossed regions, may be provided along the proximal and distal edge portions of the first inside and second outside major flaps so as to complete perimeter seals for the carton ends whereby the carton is rendered sift-proof in connection with powder or granular materials.

19 Claims, 1 Drawing Sheet

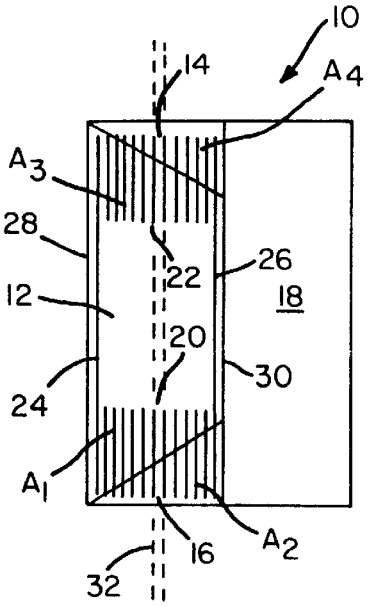
FIG. 1
PRIOR ART
FIG. 3
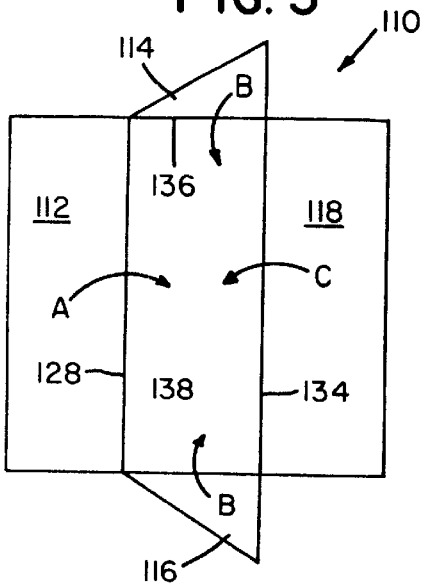
FIG. 2
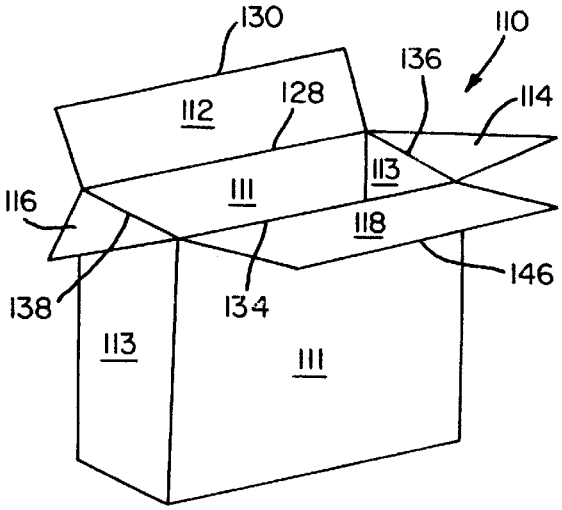
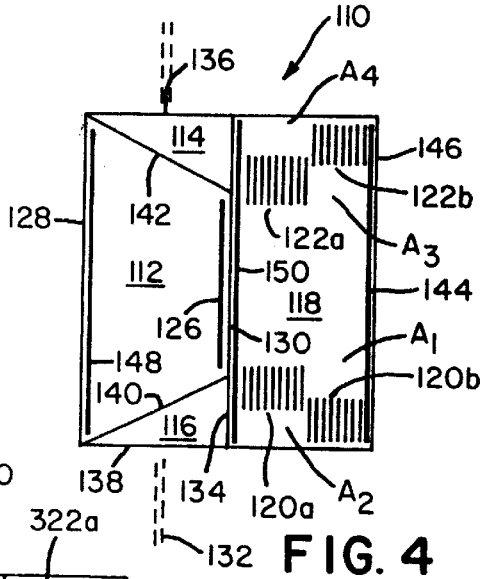
FIG. 4
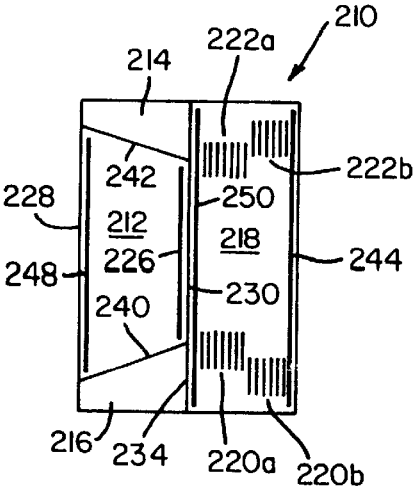
FIG. 5
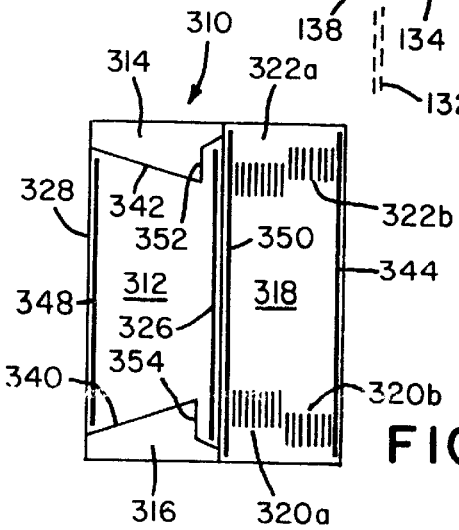
FIG. 6

CARTON CLOSURES HAVING ADHESIVE PATTERNS THEREON, AND A METHOD OF ASSEMBLING THE SAME

FIELD OF THE INVENTION

The present invention relates generally to adhesively sealed cartons, and more particularly to a linerless sift proof carton which employs a reverse folding method and has predetermined adhesive patterns applied to, and associated with, its closures so as to provide increased sealing of either end of the carton including, in particular, the sealing of the corner and end regions of the carton so as to prevent any substantial sifting or leakage of, for example, granular contents from the sealed carton regardless of the grain size, while at the same time effectively reducing the quantity of adhesive required to effectively seal the ends of the carton.

BACKGROUND OF THE INVENTION

A carton, box, or similar container is typically made from a suitable paper material, such as, for example, paperboard or the like, and includes a plurality of flaps at opposite open ends of the carton or similar container which must be folded and sealed together with respect to each other so as to provide a closed, sealed carton. Such cartons are usually provided to companies, marketing various consumer goods, in a flat, collapsed state whereupon the particular company then erects the carton, closes and seals one open end thereof, deposits a particular product into the carton, and closes and seals the opposite end of the carton.

Cartons are typically closed in accordance with any one of several different methods or modes. One type of conventional mode or method of closing or sealing a carton comprises the folding of the end flaps of the carton in accordance with what is known as a three surface "conventional fold" method or mode and then securing the flaps together by means of a suitable adhesive or other adhering or securing means. In accordance with such a three surface "conventional fold" method, the opposite minor end flaps are first folded inwardly, a first one of the major flaps is then folded inwardly so as to effectively become an inside major flap, and finally, the second major flap is folded on top of the inside major flap so as to effectively comprise an outside major flap. Thus, the carton ends are closed and sealed by means of three layers of flaps or surfaces, each of which extends across the originally open end of the carton and between which a suitable adhesive, for example, is interposed so as to achieve the adhesive bonding together of the flaps and the resulting assured sealing of the carton.

When a carton contains a granular or powdered product, the grains or powder tend to work their way or migrate out of the carton between the folded and secured flaps during shipping and handling. One way to prevent such leakage is to place the granular or powdered product within an inner liner or pouch, such as, for example, a plastic bag, secured within the carton. A liner, however, significantly increases the cost of the carton, can sometimes render the carton difficult to fill and seal with the product, and can also present recycling problems in view of the fact that the carton and liner must be separated from each other.

In view of the foregoing, further attempts to prevent leakage have resulted in the development of "sift proof" cartons which do not have liners incorporated therein and which rely upon adhesive sealing of such cartons by means of precise, predetermined patterns of various different types of adhesives applied to particular flaps, and portions thereof, of the carton and subsequent proper engagement between the flaps of the carton. Adhesively sealed sift-proof cartons formed in accordance with the aforenoted three surface conventional fold method have not been acceptable, however, particularly in connection with the containment of relatively small-grained powders, since such powders tend to leak out from the corners of the cartons as well as from improperly sealed edge portions of the cartons. Corner and end leakage primarily occurs from poor adhesion established between the minor flaps and the first inside major flap, while edge leakage primarily occurs due to the inability to achieve a proper perimeter seal upon the carton.

Another method, mode, or manner of closing a carton is in accordance with a two-surface folding procedure which typically includes the modification of the shape or configuration of the first inside major flap so as to enable the direct contact of the minor flaps with the second outside major flap. Such method tends to be more effective at preventing leakage of granular or powdered material out from the carton since one of the sealing layers or boundaries has effectively been eliminated as compared to the carton folded in accordance with the three surface conventional fold method, that is, one of the potential escape or leakage routes of the carton has been eliminated, and concentrated efforts can be implemented in connection with the remaining sealing layer or boundary so as to insure the integrity thereof.

Existing two surface folding methods, however, have typically comprised the use of poly coated/flame bonded techniques, or the use of adhesive application systems which still exhibit poor corner and edge sealing properties. In accordance with the former method, the entire surface of each flap is coated with a suitable polyer, such as, for example, a thermoplastic material or the like, and the coated flap is then subjected to flame treatment which melts the polymer and permits the flaps to be adhered together. The coating process, however, is quite costly, and can pose adverse problems with respect to certain carton contents. Thus, the use of this method has been limited. In accordance with the latter method, due to the particular predetermined patterns of the deposited or applied adhesives, the systems have been unable to achieve uniformity in connection with the beads of adhesive as applied to different portions or regions of the flaps. More particularly, certain adhesive bead regions exhibit relatively thin width dimensions, while other adhesive bead regions exhibit relatively thick or globule portions which can be squeezed out and thereby contaminate the machinery and the rails which will adversely affect the processing of the cartons. Both the relatively thin and relatively thick adhesive portions or regions present adhesive bonding problems. In connection with the relatively thin adhesive regions, the adhesive may not adequately bridge or fill the gap defined between each minor flap and the outside major flap. In addition, the relatively thin adhesive bead may solidify, gel, or cure prematurely before good or proper pressurized contact between the minor and major flaps can be established or achieved. Conversely, in connection with the relatively thick adhesive regions, the adhesive tends to retain heat for an excessive period of time whereby solidification or curing is not timely completed, and thus, proper adhesive bonding and consequent sealing is not able to be achieved. In either case, good, reliable, and proper sealing of the carton is not able to be accomplished and carton contents leakage can readily occur.

Still another method, mode, or manner of closing and sealing a carton comprises a reverse fold procedure wherein, in lieu of the conventional technique in accordance with which both of the minor flaps are first folded inwardly, the first inside major flap is then folded over the folded minor flaps, and then the second outside major flap is folded over the first inside major flap, to the contrary, and as illustrated in FIG. 1 which is a top plan view of a carton generally indicated by the reference character 10, the first inside major flap 12 is folded inwardly, and the minor end flaps 14 and 16 are folded on top of the opposite sides or end portions of the first inside major flap 12. To complete the carton, the second outside major flap 18 may be folded over on top of the minor flaps 14 and 16 and the portion of the first inside major flap 12 which is not covered by either one of the minor flaps 14 and 16.

In order to adhesively bond the first and second inside and outside major flaps 12 and 18, and the minor flaps 14 and 16, together, the carton 10 is also provided with a predetermined adhesive pattern which comprises bars or patches of adhesive 20 and 22 as well as adhesive caulking lines or beads 24 and 26. The adhesive caulking lines 24 and 26 are respectively disposed adjacent to the proximal folding edge 28 of the first inside major flap 12 and the distal free edge 30 of the first inside major flap 12, respectively, and are also disposed upon portions of the minor flaps 14 and 16 such that the caulking lines 24 and 26 extend substantially the entire length of the carton 10. The first inside and second outside major flaps 12 and 18 each have substantially rectangular configurations, while each one of the minor flaps 14 and 16 has a substantially right triangular configuration with the hypotenuse of each minor flap 14 and 16 extending from a corner of the carton, at which an end of the folding edge 28 of the first inside major flap 12 is located, toward the distal free edge 30 of the first inside major flap 12. The adhesive blocks or patches 20 and 22 have substantially rectangular configurations, they each comprise adhesive segments disposed parallel to the adhesive caulking lines 24 and 26, and the blocks or patches 20 and 22 are substantially symmetrically located with respect to the hypotenuse sides or edges of the minor flaps 14 and 16 so as to extend across the joint boundary defined between the minor flaps 14 and 16 and the inside major flap 12 by such hypotenuse sides or edges of the minor flaps 14 and 16. When the second major flap 18 is folded over on top of the minor flaps 14 and 16, as well as the first inside major flap portion which is not covered by either one of the minor flaps 14 and 16, the carton 10 is sealed by means of end seals as defined by means of the adhesive regions interposed between the several flaps as noted hereinabove.

While the aforenoted prior art reversely folded and sealed carton has exhibited adequate sealing properties, the carton and its associated manufacturing or fabrication techniques have exhibited or manifested both operational and economic drawbacks. From an economic viewpoint, since sealing is desired to be accomplished primarily along edge joint portions or regions defined between the various major and minor flaps, the provision of adhesive within regions $A_1$, $A_2$, $A_3$, and $A_4$, that is, those regions remote from the joint boundary defined between the minor flaps 14 and 16 and the inside major flap 12 by the hypotenuse sides or edges of the minor flaps 14 and 16, is effectively wasted, thereby adding unnecessary cost to the fabrication of the carton. From the operational viewpoint, during manufacture of the sealed carton, the carton 10 as illustrated in FIG. 1 is transported along or by means of a pocket of a conveyor, or support rails disposed in contact with the upper and lower ends of the carton 10, only one rail of which is shown at 32 in phantom lines. Consequently, as can be appreciated, after the adhesive has been applied to the first inside major flap 12 and the pair of minor flaps 14 and 16 in accordance with the predetermined adhesive pattern illustrated in FIG. 1, portions of the adhesive will come into contact with the folding or support rails 32. Accordingly, cured adhesive periodically accumulates upon the rails 32 which adversely affects the conveyance or support of the cartons 10 thereon, and in some cases, when a sufficient amount of the adhesive has accumulated, the accumulated adhesive tends to break off from the rails 32, particularly with respect to the upper rail, and pieces of the broken adhesive have been deposited inside the carton along with the carton contents to be used by a consumer. In addition, adhesive accumulating upon the rails, wherein the accumulated or accumulating adhesive may not be completely cured, becomes undesirably deposited upon the compression or folding rails or upon subsequently conveyed or supported cartons.

It therefore would be desirable to provide a linerless, adhesively sealed sift proof carton, and a method of assembling the same, that can accommodate a variety of granular or powdered materials without exhibiting leakage thereof, and which is especially economical to manufacture while not adversely affecting the manufacturing and erecting apparatus or system therefor.

OBJECTS OF THE INVENTION

It is therefore an object of the present invention to provide a carton having closures with a new and improved adhesive pattern thereon, and a method of assembling the carton closures so as to properly seal the open ends of the carton.

Another object of the present invention is to provide a carton having closures with a new and improved adhesive pattern thereon, and a method of assembling the carton closures in accordance with reverse fold techniques.

Still another object of the present invention is to provide a carton having closures with a new and improved adhesive pattern thereon, and a method of assembling the carton closures, such that the carton is provided with a proper perimeter seal for rendering the same sift proof in connection with granular or powdered contents.

Yet another object of the present invention is to provide a carton having closures with a new and improved adhesive pattern thereon, and a method of assembling the carton closures, wherein a proper perimeter seal can be achieved while economically depositing the adhesive upon predetermined regions of the carton closures.

A further object of the present invention is to provide a carton having closures with a new and improved adhesive pattern thereon, and a method of assembling the carton closures, such that the carton is provided with a proper perimeter seal for rendering the same sift proof, with respect to the containment of granular or powdered contents, without the need for a liner, pouch, or inner bag for holding the noted contents.

A yet further object of the present invention is to provide a carton having closures with a new and improved adhesive pattern thereon, and a method of assembling the carton closures, such that the adhesive deposited upon the carton closures in accordance with the predetermined pattern thereof does not adversely interfere with the conveyance or support apparatus employed in conjunction with the carton for assembling the same, or that such deposited adhesive does not tend to foul or become deposited upon the outside surfaces of other cartons.

SUMMARY OF THE INVENTION

The foregoing and other objectives are achieved in accordance with the present-invention through the provision of a carton which is open at both ends thereof and which is further provided with closure flaps for closing and sealing both open ends of the carton. In accordance with the present invention, the carton closures provided at both opposite ends of the carton comprise a first inside major flap pivotably attached to one side of the carton, a pair of minor flaps pivotably attached to opposite ends of the carton, and a second outside major flap pivotably attached to an opposite or second side of the carton. In accordance with the reverse fold technique employed in connection with the carton of the present invention, the first inside major flap is the first flap to be folded inwardly over its associated open end of the carton, the minor flaps are then folded inwardly so as to be disposed on top of opposite end portions of the first inside major flap, and the second outside major flap is lastly folded inwardly so as to be disposed atop the pair of minor flaps and the first inside major flap.

Contrary to the deposition of adhesive in accordance with prior art techniques wherein the aforenoted operational and economical problems or drawbacks manifested themselves, adhesive is deposited upon predetermined flaps and portions thereof in accordance with techniques or patterns unique to the present invention whereby the aforenoted operational and economical problems or drawbacks characteristic of the prior art techniques or adhesive deposition patterns are overcome and eliminated. More particularly, in lieu of applying or depositing adhesive upon predetermined portions of the first inside major flap as well as upon the pair of oppositely disposed minor end flaps prior to the inward folding of the second outside major flap, as is done in accordance with the aforenoted prior art techniques and adhesive patterns, the adhesive is deposited or applied, in accordance with the techniques and patterns of the present invention, primarily to the inside surface of the second outside major flap prior to folding the second outside major flap inwardly for mating with the first inside major flap and the pair of oppositely disposed minor end flaps. In this manner, fouling of the folding and support rail structure, as well as subsequently conveyed or supported cartons, is eliminated. In addition, in accordance with the particular, predetermined adhesive pattern or deposition technique characteristic of the present invention, in lieu of applying or depositing the adhesive to the inside surface of the second outside major flap in substantially large rectangular blocks for covering the joint lines defined between the first inside major flap and the pair of oppositely disposed minor end flaps, the adhesive is deposited or applied to inside surface portions of the second outside major flap which define relatively smaller rectangular blocks or patches which are longitudinally offset with respect to each other so as to be effectively disposed along loci which correspond to the joint lines defined between the first inside major flap and the pair of oppositely disposed minor end flaps. Adhesive is therefore not applied to regions remote or removed from such joint line loci whereby the adhesive patterns or deposition techniques of the present invention result in a reduction of approximately twenty-five to thirty-five percent (25–35%) of the amount of adhesive required to seal a carton with an attendant or concomitant reduction in adhesive costs.

In accordance with further or additional features of the present invention, the pair of oppositely disposed minor end flaps may be mitered or cut in accordance with predetermined patterns so as to enhance the corner sealing properties of the carton, and various embossing and debossing techniques may also be employed in connection with the first inside and second outside major flaps so as to likewise enhance the adhesive bonding properties of the carton. Still further, various longitudinally extending adhesive caulking lines may be employed upon the first inside and second outside major flaps so as to achieve enhanced perimeter sealing of the carton.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein:

FIG. 1 is a plan view of one end of a carton having adhesive applied to the first inside major flap and the pair of oppositely disposed minor end flaps in accordance with PRIOR ART techniques;

FIG. 2 is a perspective view of a carton to be sealed in accordance with the methods, techniques, and adhesive patterns of the present invention;

FIG. 3 is a plan view of an open end of the carton of FIG. 2 prior to the folding and sealing of the major and minor flaps of the carton in accordance with the methods, techniques, and adhesive patterns of the present invention;

FIG. 4 is a plan view of the carton of FIG. 2 with the first inside major flap and the pair of oppositely disposed minor end flaps folded inwardly with respect to each other and with respect to the carton body, and wherein adhesive has been applied to the first inside major flap and the second outside major flap in accordance with the techniques and adhesive patterns characteristic of the present invention;

FIG. 5 is a plan view similar to that of FIG. 4 except that the configuration of each one of the pair of oppositely disposed minor end flaps is substantially that of a trapezoid as opposed to a right triangle; and FIG. 6 is a plan view similar to that of FIG. 5 except that the substantially trapezoidal configuration of each one of the pair of oppositely disposed minor end flaps has been mitered or cut along the side edge portions thereof which are disposed adjacent to the second outside major flap.

DETAILED DESCRIPTION OF THE ILLUSTRATED EMBODIMENTS

Referring again to the drawings, and more particularly to FIG. 2–4 thereof, a carton, to which adhesive is to be applied in accordance with the patterns and techniques characteristic of the present invention in order to achieve the resultant sift-proof carton structure, is generally indicated by the reference character 110. The carton 110 is fabricated from a suitable conventional material, such as, for example, paperboard, and is erected from a carton blank such that the resulting carton, having, for example, the configuration of a rectangular solid, comprises a pair of oppositely disposed sides 111, each one of which is shown, and a pair of oppositely disposed ends 113, each one of which is similarly shown. The top and bottom portions of the carton 110 are initially provided in an open condition and are adapted to be closed and sealed by means of a plurality of flaps in accordance with the techniques of the present invention. Since the closure and sealing of the top and bottom portions of the carton 110 is achieved in substantially the same manner, the present invention will be described in connection with the closure and sealing of the top or upper end portion of the carton.

More particularly, it is seen, particularly from FIG. 2, that the upper end portion of the carton 110 comprises a first inside major flap 112, a pair of oppositely disposed minor end flaps 114 and 116, and a second outside major flap 118. The first inside major flap 112 has its proximal end 128 foldably connected to one of the side panels 111 of the carton, while the second outside major flap 118 has its proximal end 134 similarly foldably connected to the opposite one of the side panels 111 of the carton 110. The minor flaps 114 and 116 have their proximal ends 136 and 138 foldably connected to the upper ends of the oppositely disposed end panels 113 of the carton 110, respectively, and the foldable connections defined between the major and minor flaps 112, 114, 116, and 118 may be provided by suitable scoring techniques. The carton 110 of the present invention is adapted to be erected, closed, and sealed in accordance with reverse-fold techniques, and accordingly, as best denoted in FIG. 3, the first inside major flap 112 will be the first flap to be folded inwardly over the open upper end of the carton 110 as indicated by the lettered arrow A. This step will be followed by the inward folding of the pair of oppositely disposed minor end flaps 114 and 116 as indicated by the lettered arrows B,B such that the minor end flaps 114 and 116 are disposed atop end portions of the first inside major flap 112, as best seen in FIG. 4, and lastly, the second outside major flap 118 will be folded inwardly, as indicated by the lettered arrow C, so as to be disposed atop the oppositely disposed pair of minor flaps 114 and 116 as well as that portion of the first inside major flap 112 remaining uncovered after the minor flaps 114 and 116 have been folded inwardly. In accordance with this embodiment of the carton 110, the major flaps 112 and 118 each have substantially rectangular configurations, while each one of the minor flaps 114 and 116 has a substantially right triangular configuration, however, as will become apparent hereinafter, the particular configuration of each flap, particularly the configuration of each one of the minor flaps 114 and 116, can vary in order to achieve and accommodate different adhesive bonding techniques and capabilities.

In order to achieve the sift-proof characteristics of the carton 110 of the present invention, a suitable adhesive is applied to predetermined portions or regions of the various flaps of the carton 110 in accordance with the particular patterns and deposition techniques of the present invention. The adhesive comprises a relatively quick-setting adhesive selected so as to provide good bonding or adherence between the various flaps of the carton when the flaps are folded inwardly and engaged with each other. The adhesive is preferably applied by means of a non-contact nozzle plate or head which may be incorporated within either a conventional intermittent or continuous system and includes a plurality of adhesive outlet apertures, nozzles, or injection needles which are arranged in a plurality of zones and are suitably controlled. The carton is passed over or under the nozzle plate or head, and when the nozzle plate or head is incorporated within an intermittent typs system, the nozzle plate or head is activated when the carton is indexed or moved to the next station, whereas when the nozzle plate or head is incorporated within a continuous system, the nozzle plate or head is activated as the carton passes by. The adhesive can be a hot-melt or cold type adhesive of a suitable packaging grade, and the adhesive application or deposition apparatus or system, which includes the application head or nozzle plate, as well as the attendant valving mechanisms, may be of the type sold by the assignee of this patent application under the trade name "MOD-PLUS".

Referring now in particular to FIG. 4, the predetermined pattern or technique of applying the bonding or sealing adhesive to the various flaps of the carton 110 is illustrated. Primarily, and most significantly, in lieu of the particular adhesive pattern or technique characteristic of the PRIOR ART as illustrated within FIG. 1 wherein the blocks or patches of adhesive 20 and 22 were applied to or upon the outer surfaces of the inwardly folded, oppositely disposed pair of minor flaps 14 and 16, as well as outer surface portions of the inwardly folded first inside major flap 12, such that the adhesive block or patch regions 20 and 22 are effectively symmetrically disposed with respect to the joint or junction lines or boundaries defined between the minor flaps 14,16 and the first inside major flap 12, the carton 110 of the present invention has adhesive blocks or patches 120*a*,120*b* and 122*a*,122*b* deposited upon or applied to the inside surface of the second outside major flap 118. As a result of this particular disposition, deposition, or application of the adhesive onto or upon the inside surface of the second outside major flap 118 prior to the inward folding of the second outside major flap 118 into sealing contact with the pair of oppositely disposed minor end flaps 114 and 116, as well as that portion of the first inside major flap 112 which remains uncovered by the overlying minor end flaps 114 and 116, the folding and support rail mechanism, illustrated by means of phantom or dotted lines and denoted by reference character 132, does not encounter any adhesive as was the case of the PRIOR ART system of FIG. 1, and consequently, fouling of the conveyor or support rail mechanism 132 by accumulated adhesive, as well as the fouling of subsequently conveyed or supported cartons, is obviated or eliminated.

With continued reference to FIG. 4, it is further seen that in lieu of the relatively large adhesive block or patch regions 20 and 22 characteristic of the PRIOR ART adhesive pattern or technique as illustrated within FIG. 1, the adhesive blocks or patches 120*a* and 120*b* are relatively small and are longitudinally offset with respect to each other in the longitudinal direction which is considered to be parallel to folding and support rail 132. The adhesive blocks or patches 122*a* and 122*b* are similarly longitudinally offset with respect to each other. As a result of such longitudinal offset disposition of the adhesive blocks or patches 120*a* and 120*b*, and 122*a* and 122*b*, with respect to each other, the adhesive blocks or patches 120*a* and 120*b*, as well as adhesive blocks or patches 122*a* and 122*b*, effectively define loci which are diagonally defined upon inside surface regions of the second outside major flap 118 such that upon the inward folding of the second outside major flap 118 onto and atop the pair of minor end flaps 114 and 116, as well as onto and atop the portion of the first inside major flap 112 which remains uncovered by means of the pair of minor end flaps 114 and 116, the adhesive patches or blocks 120*a* and 120*b*, and 122*a* and 122*b*, will be disposed along the joint or junction lines 140 and 142 defined between the first inside major flap 112 and the overlying pair of minor end flaps 114 and 116. Consequently, effective adhesive sealing or bonding between the first inside major flap 112, the pair of oppositely disposed minor end flaps 114 and 116, and the second outside major flap 118 is achieved. However, still further, and quite significantly in accordance with the objectives of the present invention, adhesive is able to be effectively eliminated from the areas designated $A_1$, $A_2$, $A_3$, and $A_4$ which correspond to the similarly designated areas or regions noted in connection with the adhesive pattern blocks or patches 20 and 22 of the PRIOR ART carton 10 of FIG. 1. More particularly, it is estimated that as a result of the effective elimination of adhesive from the regions $A_1$, $A_2$, $A_3$, and $A_4$, the amount of adhesive required in order to achieve the bonding or sealing of the carton 110 in accordance with the techniques of the present invention is effectively reduced approximately twenty-five to thirty percent (25–30%).

It is noted that each one of the adhesive blocks or patches 120*a*, 120*b*, 122*a*, and 122*b* comprises a plurality of longitudinally extending, parallel segments or beads of adhesive laterally spaced apart from each other by means of a predetermined distance. It is to be noted, however, that despite the disposition of such adhesive segments, a complete adhesive seal is provided, for example, along the joint or junction lines 140 and 142 defined between the first inside major flap 112 and the overlying pair of minor end flaps 114 and 116. This is due to the outward flow or lateral distribution or spread of the adhesive which effectively fills the gaps defined between the individual adhesive beads or segments when the second outside major flap 118 is folded inwardly onto the minor end flaps 114 and 116, as well as onto those portions of the first inside major flap 112 which remain uncovered after the minor flaps 114 and 116 are folded inwardly, and compressed into engagement with the minor end flaps 114 and 116, as well as the first inside major flap 112.

In addition to the adhesive blocks or patches 120*a*, 120*b*, 122*a*, and 122*b* provided upon the inside surface of the second major flap 118, an adhesive caulking line or bead 144 is also disposed upon the inside surface of the second outside major flap 118 so as to extend longitudinally adjacent to the distal edge portion 146 of the second outside major flap 118. When the second outside major flap 118 is folded inwardly so as to be disposed atop the pair of minor end flaps 114 and 116, as well as the first inside major flap 112, the distal edge portion 146 of the second outside major flap 118 will mate or be aligned with the proximal edge portion 128 of the first inside major flap 112, and upon compression engagement of the second outside major flap 118 into contact with the proximal edge portion 128 of the first inside major flap 112, the adhesive caulking line or bead 144 will define an adhesive bond between the distal edge portion 146 of the second outside major flap 118 and the proximal edge portion 128 of the first inside major flap 112. Still further, a second adhesive caulking line or bead 126 is disposed upon the outside surface of the first inside major flap 112 so as to extend longitudinally adjacent to the distal edge portion 130 of the first inside major flap 112 and to be interposed between the pair of oppositely disposed minor end flaps 114 and 116. In this manner, when the second outside major flap 118 is folded inwardly so as to be disposed atop the pair of minor end flaps 114 and 116, as well as the first inside major flap 112, the proximal edge portion 134 of the second outside major flap 118 will be disposed atop the exposed region of the distal edge portion 130 of the first inside major flap 112, upon which the second adhesive caulking line or bead 126 is disposed, and upon compression engagement of the second outside major flap 118 into contact with the first inside major flap 112, the second adhesive caulking line or bead 126 will define an adhesive bond between the exposed region of the distal edge portion 130 of the first inside major flap 112 and the mating region of the proximal edge portion 134 of the second outside major flap 118. As can therefore be appreciated, the upper end portion of the carton 110 is effectively provided with a proper, sift-proof perimeter seal with respect to its various interengaged flaps as defined by means of the adhesively bonded region formed between the first inside major flap 112 and the second outside major flap 118 along the second adhesive caulking line or bead 126, the adhesively bonded region formed between the first inside major flap 112 and the minor end flap 116, with respect to the second outside major flap 118, along the adhesive patch or block regions 120*a* and 120*b*, and along the junction or joint line 140, the adhesively bonded region formed between the first inside major flap 112 and the second outside major flap 118 along the adhesive caulking line or bead 144, and the adhesively bonded region formed between the first inside major flap 112 and the minor end flap 114, with respect to the second outside major flap 118, along the adhesive patch or block regions 122*b* and 122*a*, and along the junction or joint line 142.

While the aforenoted adhesive deposits are sufficient for providing a proper and secure sift-proof seal and carton, additional adhesive deposits may optionally be provided upon the various surfaces of the flap closures. For example, in addition to the adhesive caulking line 144 defining the adhesive bond between the distal edge portion 146 of the second outside major flap 118 and the proximal edge portion 128 of the first inside major flap 112, a third adhesive caulking line 148 may be provided or deposited upon the outer surface of the first inside major flap 112 so as to extend longitudinally along or adjacent to the proximal edge portion 128 of the first inside major flap 112. The reason for the presence of this additional adhesive caulking line or bead 148 is that when the second outside major flap 118 is folded inwardly over upon top of the minor flaps 114 and 116 and the exposed region of the first inside major flap 112, there is, in effect, a gap defined between the inside surface of the second outside major flap 118 and the outer surface of the first inside major flap 112 which is substantially equal to the thickness dimension of the minor flaps 114 and 116 which are interposed between the folded second outside major flap 118 and the first inside major flap 112. If only the adhesive caulking line or bead 144 was provided near the distal edge portion 146 of the second outside major flap 118, such line or bead 144 would have a thickness dimension which may prevent the adhesive from properly curing within the requisite time required to establish a good, secure bond with the proximal edge region 128 of the first inside major flap 112 when the second outside major flap 118 was folded thereover. Consequently, if such adhesive line or bead was effectively provided upon both the first inside major flap 112 and the second outside major flap 118 as caulking lines or beads 148 and 144, with each bead having, in effect, half the thickness dimension of the sole caulking line or bead 144, then proper curing of the adhesive would be achieved when the first and second inside and outside major flaps 112 and 118 were contacted and compressively engaged with each other.

In a similar manner, and for similar reasons as noted with respect to the provision of third caulking line or bead 148, a fourth adhesive caulking line or bead 150 may be provided so as to extend longitudinally along and adjacent to the proximal edge portion 134 of the second outside major flap 118. Caulking line or bead 150 is provided upon the inside surface of the second outside major flap 118 and is adapted to adhesively mate or bond with the second adhesive caulking line or bead 126 provided upon the distal edge portion 130 of the first inside major flap 112. It is noted that the fourth adhesive caulking line or bead 150 is illustrated as extending substantially throughout the entire longitudinal extent of the carton 110, however, the longitudinal extent of the fourth adhesive caulking line or bead 150 can be shortened so as to effectively correspond to the longitudinal extent of the second adhesive caulking line or bead 126. It is further noted that the various adehsive deposits comprising the adhesive caulking lines or beads 148, 126, 150, and 144, as well as the adhesive segments comprising the adhesive blocks or patches 120*a*, 120*b*, 122*a*, and 122*b* are readily applied by means of adhesive heads or modules which are independently controllable and adjustable so as to deposit the particular adhesive lines, beads, or segments as desired or required. For example, in accordance with the present invention system or technique, four adhesive heads or modules can apply or deposit the aforenoted adhesive beads, lines, or segments upon the various surfaces of the carton flaps. More particularly, a first module or head can be used to apply the adhesive blocks or patches 120*a* and 122*a*, a second module or head can be used to apply the adhesive blocks or patches 120*b* and 122*b*, a third module or head can be used to apply the adhesive caulking lines or beads 150 and 144, and a fourth module or head can be used to apply the adhesive caulking lines or beads 148 and 126. It is lastly noted that even when the caulking lines or beads 148 and 126 are deposited upon the outer surface of the inwardly folded first inside major flap 112, such adhesive deposits still do not interfere with or encounter the conveyor or support rail 132 whereupon fouling of the latter does not occur as in the PRIOR ART system.

As a further alternative of the present invention, and in order to eliminate, in effect, the doubling or duplication of the adhesive deposits within certain regions of the completed, folded and sealed carton, such as, for example, within the regions comprising adhesive deposits or caulking lines 144 and 148, and 126 and 150, the edge portions of the first inside and second outside major flaps may be provided with suitable embossed or debossed regions or areas in lieu of the adhesive caulking lines. For example, in lieu of the third adhesive caulking line 148, the first inside major flap 212, of a carton 210, may be provided with an embossed region 248 which extends longitudinally along the proximal edge portion 228 between the pair of oppositely disposed minor end flaps 214 and 216 as shown in FIG. 5. As a result of such embossing of the first inside major flap 212 within the vicinity of its proximal edge portion 228, the thickness dimension of such embossed region 248 is greater than that of the remaining portion of the first inside major flap 212 such that such embossed region compensates for the gap or space defined between the first inside major flap 212 and the second outside major flap 218 as has been determined as a result of the interdisposition of the minor end flaps 214 and 216 between the first inside and second outside major flaps 212 and 218. Consequently, the first adhesive caulking line or bead 244 can properly engage the embossed region 248 of the first inside major flap 212 so as to be adhesively bonded thereto. In a similar manner, in lieu of the second adhesive caulking line or bead 126, an embossed region 226 can be provided upon the first inside major flap 212 within the vicinity of the distal edge portion 230 thereof such that proper adhesive bonding can be achieved between such embossed region 226 and the fourth adhesive caulking line or bead 250 disposed upon the second outside major flap 218 within the vicinity of the proximal edge portion 234 thereof. It is additionally noted that in connection with the carton 210 of FIG. 5, in order to enhance sealing of the corner regions of the carton 210, the pair of oppositely disposed minor end flaps 214 and 126 each have a substantially trapezoidal configuration such that all corner regions of the carton 210 are covered by means of the inward folding of the first inside major flap 212 and the subsequent inward folding of the minor end flaps 214 and 216 atop the opposite end portions of the inside major flap 212. The inside surface of the second outside major flap 218 is also, of course, provided with the adhesive patches or blocks 220*a*, 220*b*, 222*a*, and 222*b* in order to properly seal the joint or junction lines or boundaries 240 and 242 defined between the minor end flaps 214, 216 and the first inside major flap 212 and thereby form part of the perimeter seal for the carton 210 as noted hereinabove.

Referring lastly to FIG. 6, there is illustrated a carton generally indicated by the reference character 310, and it is seen that such carton 310 is substantially the same as carton 210 of FIG. 2 except that the pair of oppositely disposed minor end flaps 314 and 316 are provided with additional cut-out or mitered portions 352 and 354 which permit the embossed region 326 to extend substantially the entire longitudinal length of the carton 310. The embossed region 348 is also provided within the vicinity of the proximal edge portion 328 of the first inside major flap 312, and the adhesive caulking lines or beads 344 and 350 are provided upon the inside surface of the second outside major flap 318 for mated engagement with the embossed regions 348 and 326, respectively. The inside surface of the second outside major flap 318 is also, of course, provided with the adhesive patches or blocks 320*a*, 320*b*, 322*a*, and 322*b* for adhesively bonding the joint regions 340 and 342 defined between the minor end flaps 314,316 and the first inside major flap 312 such that a complete perimeter seal is provided for the carton 310. The particular configuration of the minor end flaps 313 and 316, that is, still being of a substantially trapezoidal configuration, also provides enhanced corner sealing for the carton 310.

Thus it may be seen that in accordance with the principles of the present invention, a new and improved linerless, sift-proof carton, and a method of erecting the same, has been provided whereby the cartons can be erected and adhesively sealed by means of adhesive deposits strategically placed upon the carton closures or flaps without adversely affecting or fouling conveyor or support mechanisms used in conjunction with the carton erection or assembling equipment. In addition, the amount of adhesive required to be used in erecting the cartons can be substantially reduced while nevertheless achieving a proper perimeter seal for each end of the carton.

Obviously, many modifications and variations of the present invention are possible in light of the above teachings. For example, in lieu of the particularly disclosed adhesive caulking lines or beads, as well as the particularly disclosed embossed regions, various permutations and combinations of such elements are also of course contemplated. In the embodiment of FIG. 4, for example, in lieu of the adhesive caulking lines or beads 144 and 148 as illustrated, the second outside major flap 118 may be provided with a debossed region extending longitudinally adjacent to the distal edge portion 146 thereof, and the adhesive caulking line 144 could be deposited thereon. As a result of the provision of such debossed area, which would compensate for the space or gap defined between the first and second inside and outside major flaps 112 and 118 when the second outside major flap 118 is folded inwardly over the first inside major flap 112, and due to the interdisposition of the minor end flaps 114 and 116 therebetween, the adhesive caulking line 148 can be eliminated. It is further contemplated that other combinations of caulking lines or beads, and embossed and debossed areas, deposited or formed upon strategic portions of the various major and minor flaps are within the purview of the present invention. Still further, in lieu of the particularly configured minor end flaps as illustrated in FIGS. 4–6, the minor end flaps could have a substantially rectangular configuration whereby the adhesive blocks or patches, for example, 122*a* and 122*b*, and 120*a* and 120*b*, would not be longitudinally offset with respect to each other but would be longitudinally aligned with respect to each other and, in effect, form a single adhesive patch or block which would nevertheless, contrary to the PRIOR ART arrangement of FIG. 1, be disposed upon the inside surface of the second outside major flap and also still provide a seal across the joint or junction lines defined between the minor end flaps and the first inside major flap. It is therefore to be understood that within the scope of the appended claims, the present invention may be practiced otherwise than as specifically described herein.

What is claimed as new and desired to be secured by Letters Patent of the United States of America, is:

1. A sift proof carton, comprising:

a carton member having at least one open end and comprising a first inside major flap, a second outside major flap, and a pair of oppositely disposed minor flaps, each one of said flaps including a first proximal end connected along a fold line to a body portion of said carton member for pivotal movement with respect to said at least one open end of said carton member for closing said at least one open end of said carton member when folded inwardly, said first inside major flap comprising a first closure surface with respect to said at least one open end of said carton member when folded inwardly, said pair of oppositely disposed minor flaps comprising a second closure surface with respect to said at least one open end of said carton member by being disposed upon said first inside major flap when said pair of oppositely disposed minor flaps are folded inwardly, and said second outside major flap comprising a third closure surface when folded inwardly with respect to said at least one open end of said carton member by being disposed upon both said pair of oppositely disposed minor flaps and portions of said first inside major flap not covered by said pair of oppositely disposed minor flaps and thereby exposed and accessible to said second outside major flap, a pair of joint lines being defined between said pair of oppositely disposed minor flaps and said first inside major flap at locations at which said pair of oppositely disposed minor flaps encounter said first inside major flap when said pair of oppositely disposed minor flaps are folded inwardly onto said first inside major flap; and adhesive means disposed upon inside surface portions of said second outside major flap for disposition upon said pair of joint lines, defined between said pair of oppositely disposed minor flaps and said first inside major flap, when said second outside major flap is folded inwardly onto said pair of oppositely disposed minor flaps and said portions of said first inside major flap not covered by said pair of oppositely disposed minor flaps;

said pair of joint lines defined between said pair of oppositely disposed minor flaps and said first inside major flap comprise diagonal loci; and said adhesive means disposed upon said inside surface portions of said second outside major flap is disposed alone diagonal loci which correspond to said diagonal joint line loci defined between said pair of oppositely disposed minor flaps and said first inside major flap.

2. A carton as set forth in claim 1, wherein:

said pair of oppositely disposed minor flaps each has a substantially right-triangular configuration with a hypotenuse portion thereof defining each one of said joint lines; and said adhesive means disposed upon said inside surface portions of said second outside major flap are disposed along diagonal loci which correspond to said hypotenuse joint lines when said second outside major flap is folded inwardly onto said pair of oppositely disposed minor flaps and said first inside major flap.

3. A carton as set forth in claim 2, wherein:

said adhesive means comprise pairs of longitudinally offset adhesive patches which define said diagonal loci.

4. A carton as set forth in claim 3, wherein:

each one of said adhesive patches comprises a plurality of longitudinally extending, parallel adhesive segments.

5. A carton as set forth in claim 1, wherein:

said first and second inside and outside major flaps have distal edge portions disposed opposite said proximal ends thereof;

a first adhesive caulking line is disposed upon said inside surface of said second outside major flap so as to extend longitudinally parallel to said distal edge portion thereof and for adhesively bonding with an outside surface portion of said first inside major flap defined longitudinally along said proximal end thereof; and a second adhesive caulking line is disposed upon an outside surface portion of said first inside major flap so as to extend longitudinally parallel to said distal edge portion thereof and for adhesively bonding with an inside surface portion of said second outside major flap defined longitudinally along said proximal end thereof, whereby a perimeter seal for said carton, comprising said first adhesive caulking line, said adhesive means disposed upon said joint lines, and said second adhesive caulking line, is established.

6. A carton as set forth in claim 5, further comprising:

a third adhesive caulking line disposed upon an outside surface portion of said first inside major flap and extending longitudinally parallel to said proximal end thereof for adhesive mating with said first adhesive caulking line of said second outside major flap; and a fourth adhesive caulking line disposed upon an inside surface portion of said second outside major flap and extending longitudinally parallel to said proximal end thereof for adhesive mating with said second adhesive caulking line of said first inside major flap.

7. A carton as set forth in claim 1, wherein:

said pair of oppositely disposed minor flaps each has a substantially trapezoidal configuration with one of the non-parallel sides thereof defining each one of said joint lines; and said adhesive means disposed upon said inside surface portions of said second outside major flap are disposed along diagonal loci which correspond to said joint lines when said second outside major flap is folded inwardly onto said pair of oppositely disposed minor flaps and said first inside major flap.

8. A carton as set forth in claim 7, wherein:

each one of said pair of oppositely disposed minor flaps has a longitudinally extending mitered cut-out portion such that an adhesive caulking line can extend upon said first inside major flap throughout substantially the entire longitudinal extent of said first inside major flap.

9. A carton as set forth in claim 8, wherein:

said mitered cut-out portions of said pair of minor flaps are disposed adjacent to distal edge portions of said first inside major flap; and an additional adhesive caulking line is disposed upon an inside surface portion of said second outside major flap which is adjacent to said proximal end of said second outside major flap, whereby said adhesive caulking line of said second outside major flap is accommodated within said mitered cut-out portions of said pair of minor flaps.

10. A carton as set forth in claim 9, further comprising:

an embossed region formed within said first inside major flap, projecting toward said second outside major flap when said second outside major flap is folded inwardly over said pair of minor flaps and said first inside major flap, and extending adjacent to said distal edge of said first inside major flap, for reducing the space dimension defined between said first and second inside and outside major flaps when said second outside major flap is folded inwardly over said first inside major flap as a result of the interdisposition of said pair of minor flaps between said first and second inside and outside major flaps.

11. A carton as set forth in claim 7, further comprising:

an adhesive caulking line disposed upon an inside surface portion of said second outside major flap so as to be disposed adjacent to a distal edge of said second outside major flap; and said first inside major flap has an embossed region, projecting toward said second outside major flap when said second outside major flap is folded inwardly over said pair of minor flaps and said first inside major flap, and extending adjacent to said proximal end of said first inside major flap for reducing the space dimension defined between said first and second inside and outside major flaps when said second outside major flap is folded inwardly over said first inside major flap as a result of the interdisposition of said pair of minor flaps between said first and second inside and outside major flaps such that said adhesive caulking line can properly adhesively bond with said pair of minor flaps and said first inside major flap.

12. A method of folding and sealing the major and minor flaps of a carton so as to provide a sift-proof carton, comprising the steps of:

providing a carton with at least one open end defined by a first inside major flap, a second outside major flap, and a pair of oppositely disposed minor flaps, each one of said flaps including a first proximal end connected along a fold line to a body portion of said carton for pivotal movement with respect to said at least one open end of said carton for closing said at least one open end of said carton when said first and second inside and outside major flaps and said pair of oppositely disposed minor flaps are folded inwardly;

folding said first inside major flap inwardly so as to cover said at least one open end of said carton;

folding said pair of oppositely disposed minor flaps inwardly such that said pair of oppositely disposed minor flaps cover opposite end portions of said first inside major flap and define with said opposite end portions of said first inside major flap a pair of diagonal joint lines at locations at which said pair of oppositely disposed minor flaps encounter said first inside major flap when said pair of oppositely disposed minor flaps are folded inwardly onto said first inside major flap;

applying adhesive means upon inside surface portions of said second outside major flap which comprise diagonal loci corresponding to said diagonal joint lines, defined between said pair of oppositely disposed minor flaps and said first inside major flap, such that said adhesive means disposed upon said inside surface portions of said second outside major flap along said diagonal loci, will mate with said diagonal joint lines defined between said pair of oppositely disposed minor flaps and said first inside major flap when said second outside major flap is folded inwardly onto said pair of oppositely disposed minor flaps and said first inside major flap; and folding said second outside major flap inwardly onto said pair of oppositely disposed minor flaps and said first inside major flap such that said adhesive means disposed alone said diagonal loci is engaged with said diagonal joint lines defined between said pair of oppositely disposed minor flaps and said first inside major flap.

13. A method as set forth in claim 12, further comprising the steps of:

providing a first adhesive caulking line upon said inside surface of said second outside major flap so as to extend longitudinally parallel to a distal edge portion thereof for adhesive bonding with an outside surface portion of said first inside major flap along said proximal end thereof; and providing a second adhesive caulking line upon an outside surface portion of said first inside major flap so as to extend longitudinally parallel to a distal edge portion thereof for adhesive bonding with an inside surface portion of said second outside major flap along said proximal end thereof, whereby a perimeter seal for said carton, comprising said first adhesive caulking line, said adhesive means disposed upon said joint lines, and said second adhesive caulking line, is established.

14. A method as set forth in claim 12, further comprising the steps of:

arranging said adhesive means in pair of longitudinally offset adhesive patches; and forming each one of said adhesive patches by depositing adhesive in a plurality of longitudinally extending, parallel adhesive segments.

15. A method as set forth in claim 12, further comprising the steps of:

providing each one of said pair of oppositely disposed minor flaps with a longitudinally extending mitered cut-out portion which is disposed adjacent to distal edge portions of said first inside major flap; and providing an adhesive caulking line upon an inside surface portion of said second outside major flap which is disposed adjacent to said proximal end of said second outside major flap such that said adhesive caulking line is accomodated within said mitered cut-out portions of said pair of minor flaps and is able to extend longitudinally throughout substantially the entire longitudinal length of said carton.

16. A method as set forth in claim 12, further comprising the steps of:

providing said first inside major flap with an embossed region, projecting toward said second outside major flap folded inwardly over said pair of minor flaps and said first inside major flap, and extending adjacent to a distal edge portion of said first inside major flap, for reducing the space dimension defined between said relatively folded first and second inside and outside major flaps as a result of the interdisposition of said pair of minor flaps between said first and second inside and outside major flaps; and providing an adhesive caulking line upon an inside surface portion of said second outside major flap which is disposed adjacent to said proximal end of said second outside major flap such that said adhesive caulking line will adhesively bond with said pair of minor flaps and said embossed region of said first inside major flap as a result of said second outside major flap being folded inwardly over said pair of minor flaps and said first inside major flap.

17. A method as set forth in claim 12, further comprising the steps of:

providing said first inside major flap with an embossed region, projecting toward said second outside major flap folded inwardly over said pair of minor flaps and said first inside major flap, and extending adjacent to said proximal end of said first inside major flap, for reducing the space dimension defined between said relatively folded first and second inside and outside major flaps, as a result of the interdisposition of said pair of minor flaps between said first and second inside and outside major flaps; and providing an adhesive caulking line upon an inside surface portion of said second outside major flap which is disposed adjacent to a distal edge of said second outside major flap such that said adhesive caulking line will adhesively bond with said pair of minor flaps and said embossed region of said first inside major flap as a result of said second outside major flap being folded inwardly over said pair of minor flaps and said first inside major flap.

18. A method as set forth in claim 12, further comprising the steps of:

providing each one of said pair of oppositely disposed minor flaps with a substantially right-triangular configuration such that a hypotenuse portion thereof defines each one of said diagonal joint lines; and applying said adhesive means upon said inside surface portions of said second outside major flap along said diagonal loci so as to correspond to said hypotenuse joint lines defined between said pair of oppositely disposed minor flaps and said first inside major flap.

19. A method as set forth in claim 12, further comprising the steps of:

providing each one of said pair of oppositely disposed minor flaps with a substantially trapezoidal configuration with one of the non-parallel sides thereof defining each one of said diagonal joint lines; and applying said adhesive means upon said inside surface portions of said second outside major flap along said diagonal loci so as to correspond to said diagonal joint lines defined between said pair of oppositely disposed minor flaps and said first inside major flap.

* * * * *